United States Patent [19]

Lahm

[11] 4,086,480

[45] Apr. 25, 1978

[54] SUSPENSION CEILING AND RECESSED LIGHTING SYSTEM

[75] Inventor: Albert H. Lahm, Lorain, Ohio

[73] Assignee: Donn Products, Inc., Westlake, Ohio

[21] Appl. No.: 726,160

[22] Filed: Sep. 24, 1976

[51] Int. Cl.[2] ..... F21S 00/00

[52] U.S. Cl. ..... 362/148; 248/343; 362/225

[58] Field of Search ..... 240/9 R, 51.11 R, 73 BC, 240/73 BA, 73 BJ; 248/201, 343; 52/28, 39

[56] References Cited

U.S. PATENT DOCUMENTS

| | | | |
|---|---|---|---|
| 2,291,490 | 7/1942 | Naysmith | 240/51.11 R |
| 2,376,715 | 5/1945 | Naysmith | 240/51.11 R |
| 2,831,962 | 4/1958 | Winkler et al. | 240/9 R |
| 2,854,205 | 9/1958 | Kruger | 248/343 |
| 3,512,313 | 5/1970 | Harz | 52/28 |

*Primary Examiner*—J D Miller

*Assistant Examiner*—Peter S. Wong

*Attorney, Agent, or Firm*—McNenny, Pearne, Gordon, Gail, Dickinson & Schiller

[57] ABSTRACT

An integrated suspension ceiling and recessed lighting fixture system is disclosed in which a fixture is supported primarily on arched bridging members which extend between parallel runs of the grid of the suspension ceiling. The bridging members lock at their ends in the runs and maintain a predetermined spacing between the runs thus permitting relatively long uninterrupted fixtures to be installed in the suspension ceiling. The bridging members also support a continuous channel or raceway which permits the fixture to be wired as a unit regardless of its total length. A reflector is supported by flanges of the inverted tees constituting the runs along the sides of the fixture so separate framing is not required. With the invention recessed lighting fixtures of substantially any desired length may be installed in a suspension ceiling system.

20 Claims, 9 Drawing Figures

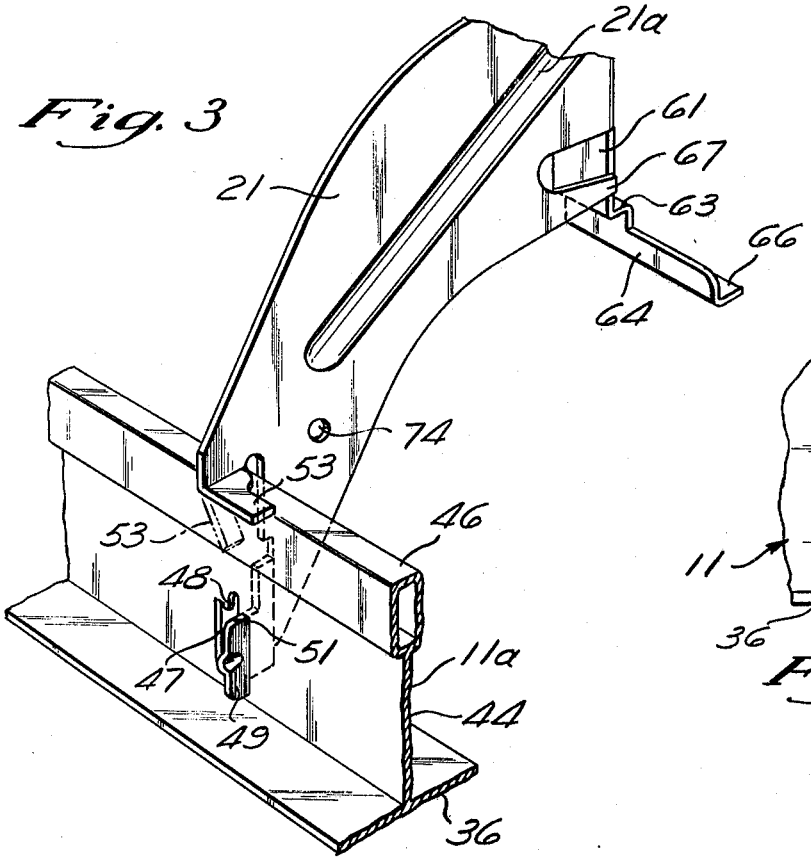
Fig. 3
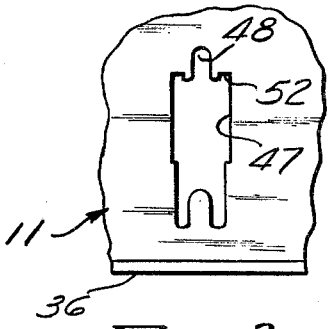
Fig. 3a
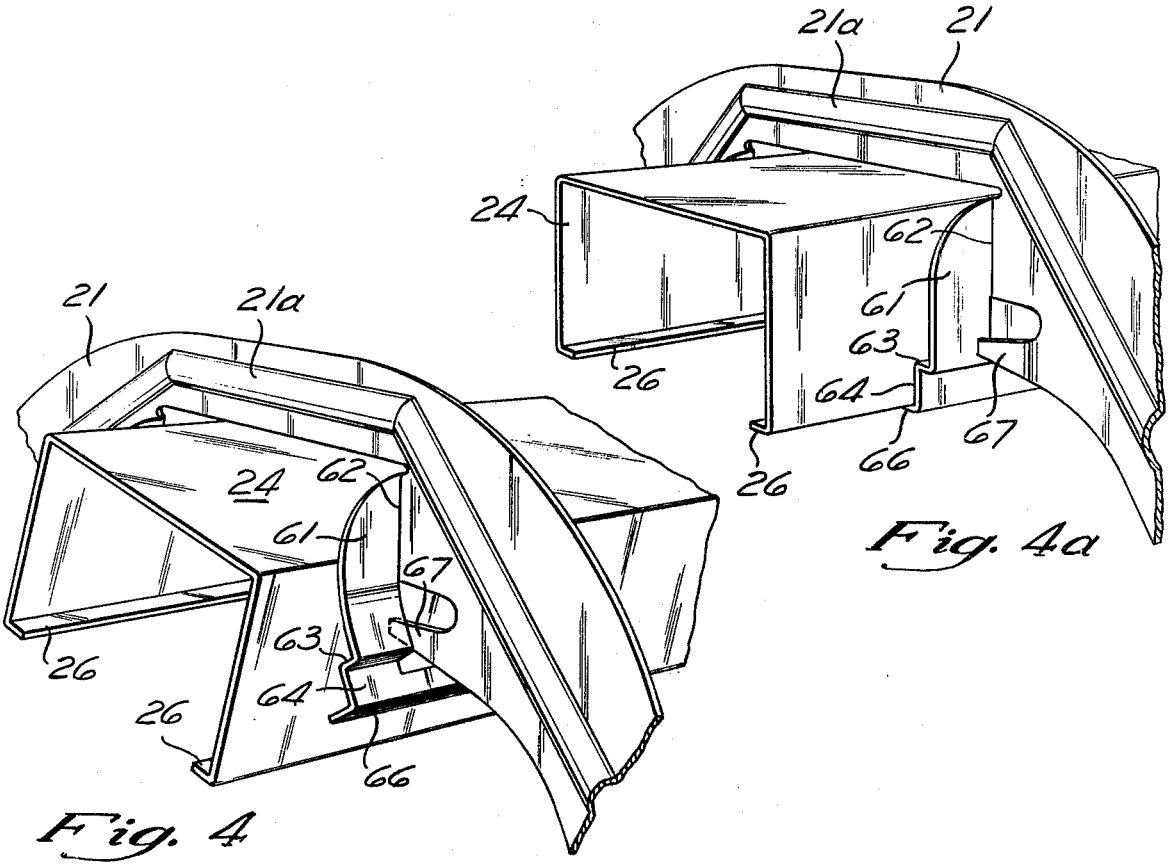
Fig. 4a
Fig. 4

SUSPENSION CEILING AND RECESSED LIGHTING SYSTEM

BACKGROUND OF THE INVENTION

This invention relates generally to ceiling lighting system and more particularly to a novel and improved integrated suspension ceiling and recessed lighting system.

PRIOR ART

Suspension ceiling systems which include a planar grid of inverted tee shaped members are well known. Such grids usually include a plurality of parallel main runs which are suspended from the building structure and a plurality of parallel cross runs consisting of cross members connected and supported at their ends to the main runs. Such runs are assembled to define rectangular panel opening. Ceiling panels are positioned in such openings and are supported by flanges of the tee members surrounding each opening.

In addition, various types of fluorescent lighting fixtures are known for use in such system. Some are recessed and are mounted so that the lower surface thereof is in the ceiling plane. Others are surface mounted types and are supported below the ceiling plane. When long fixtures are required they are generally surface mounted or suspended, and can be assembled from end connected sections as illustrated in the U.S. Pat. No. 2,368,810 granted Feb. 6, 1945.

Generally, the recessed fixtures are separate units which are installed substantially as a unit within a single grid opening and have a length and width proportional to fill an opening defined by the grid. In most instances the lighting fixture framing structure is supported on the flanges of the tees. Such fixtures must usually be separately installed and wired. Examples of ceiling fixtures of this general type are illustrated in the U.S. Pat. Nos. 3,271,570 granted Sept. 6, 1966; and 3,435,204 granted Mar. 25, 1969.

In other instances fixtures are arranged to be supported by bridging structure which is supported by portions of the grid other than the flange or by other building structure. Examples of such structures are illustrated in the U.S. Pat. Nos. 2,291,489 granted July 28, 1942; 2,321,099 granted June 8, 1943; 2,597,875 granted May 27, 1952; 2,710,036 granted June 7, 1955; 2,831,962 granted Apr. 22, 1958; 2,852,663 granted Sept. 16, 1958; and 3,352,071 granted Nov. 14, 1967.

SUMMARY OF THE INVENTION

There are a number of important aspects to the present invention. In accordance with one important aspect of this invention a novel and improved integrated suspended ceiling and recess lighting system is provided. In such system a relatively long uninterrupted lighting assembly can be provided in which the assembly is not limited to the length of a grid module.

In accordance with another important aspect of this invention a novel and improved system is provided in which the assembled fixture is assembled with a raceway channel which can be wired as a unit or which can be assembled from pre-wire channel sections which are plugged together during installation. Either form of channel greatly reduces the labor cost of wiring the system and a single power supply can be used for a very long fixture.

In accordance with still another important aspect of this invention, a novel and improved system is provided which is easily assembled without screws, nuts or bolts, so that the labor of installation is substantially reduced.

In accordance with still another important aspect of this invention a novel and improved suspension ceiling recess lighting system is provided in which the grid itself provides the trim or border for the lighting fixture. This eliminates the requirement for separate framing and provides an improved appearance.

In a preferred embodiment which is illustrated the grid is provided with continuous lighting openings of substantially any desired length. For example, such openings. can extend substantially the entire length of long rooms. Such openings are uninterrupted by grid tees. A plurality of bridging members extend across such openings and are locked into the grid runs which extend along the sides of the openings. These bridging members serve a dual function. First, they provide the principal supports of the fixture. Second, they provide a rigid cross-tie between the side runs which stabilizes the grid even when it is uninterrupted by long light openings. In effect, the bridging elements constitute a part of the grid system and also a part of the lighting fixture.

Mounted on the bridging members is a channel assembly which provides the wiring raceway for the fixture. Such channel assembly includes a plurality of end connected channel members. The channel members may be arranged to be continuous so that the entire fixture may be wired as a unit or may be assembled from pre-wired channel sections which are provided with plugs at their ends so that the sections are connected one with another as they are installed. In either event the entire fixture requires only one external power supply and it is not necessary to separately supply each of a plurality of separate fixtures with power.

A reflector closes the raceway and has side edges which extend over, and are supported by the flanges of tee members extending along the sides of the opening. Consequently, the finished appearance is provided without requiring separate fixture framing.

Further, the illustrated fixture is structured for fabrication from simple stamped or roll formed parts which can be manufactured cheaply and can be easily installed.

These and other aspects of this invention are more fully described in the following description and drawings.

BRIEF DESCRIPTION OF THE DRAWINGS

FIG. 3 is an enlarged fragmentary perspective view illustrating a preferred structure for mounting the ends of the bridging members on the grid;

FIG. 3*a* is a fragmentary side elevation illustrating the connection opening in the tee member into which the bridging member connects.

FIG. 4 is an enlarged fragmentary perspective view illustrating the bridging member and channel as the channel is moved toward the assembled position within the bridging member;

FIG. 4*a* is a perspective view similar to FIG. 4 illustrating the bridging member and channel in the assembled position;

DETAILED DESCRIPTION OF THE DRAWINGS

Figure 1:
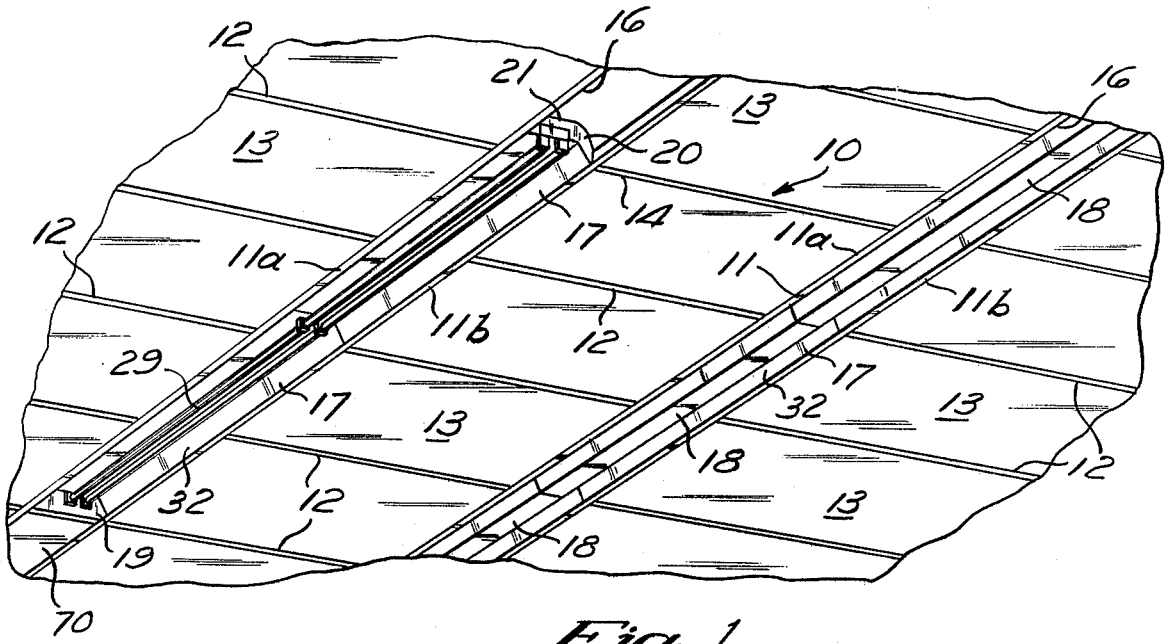
FIG. 1 is a perspective view illustrating a typical suspension ceiling lighting fixture system incorporated in the present invention with parts removed in portions of the Figure for purposes of illustration.

FIG. 1 illustrates a typical integrated suspension ceiling and lighting fixture system in accordance with the present invention. In such ceiling a grid 10 is formed of inverted tee members arranged in main runs 11 and cross runs 12. Generally the main runs 11 are suspended from the building structure and are assembled from a plurality of end connected main run members. The cross runs 12 are usually formed of separate cross members which are connected at their ends and are supported by and extend between such main runs.

The main runs and cross runs cooperate in the usual manner to define rectangular panel openings 14 bounded by the main tees and cross tees which cooperate to provide inwardly extending flanges which support panels 13. The openings 14 in which the panels fit are generally rectangular or square as desired.

With the conventional recessed lighting fixture, the fixture is usually sized to fit into either a full panel opening or some basic fraction thereof. Where it is necessary to provide a row of lights the general practice in the past has been to install a separate fixture in each of a plurality of aligned panel openings and it has been generally necessary to separately connect the fixtures with the result that the wiring costs are relatively high.

FIG. 1, however illustrates an embodiment of this invention in which the grid 10 is provided with relatively long uninterrupted lighting assemblies which have an assembled length substantially greater than the length of the ceiling panel opening 14. In fact, in the illustrated embodiment of FIG. 1 each lighting assembly can extend substantially the full length of the ceiling and provide an uninterrupted lighting assembly of such length. It should be understood, however, that this invention is not limited to lighting assemblies which extend the full length of a given room in which they are installed.

The grid 10 of FIG. 1 is provided with two lighting openings 16 which are uninterrupted by cross tees for the entire length of the lighting fixture assembly. Such lighting openings can be of length up to the length or width of the ceiling. Located in each of the lighting openings 16 is a lighting assembly 17 which extends in an uninterrupted manner throughout substantially the entire length of the associated opening. In FIG. 1 the lighting assembly 17 to the left is illustrated with the diffuser 18 removed and with the lighting assembly extending from one end 19 and terminating at a location 20 intermediate the ends of the associated opening 16 for purposes of illustration. However, when fully assembled such fixture would extend beyond the location 20 to its other end. Such lighting assembly 17 includes a plurality of aligned and end connected subassemblies 18 which are preferably constructed of a standard length such as 8 feet. In the illustrated embodiment the panel openings are two feet by four feet and the width of the lighting opening 16 is one foot. Generally, commercial grids are provided with main runs assembled from main tee members twelve feet long and cross tee members having a length equal to the desired spacing between main runs. In the illustrated embodiment the cross tees are 4 feet long.

Extending along the sides of each of the panel openings are side main runs **11*a* and 11*b*. As illustrated there are no cross tees connected between the side runs 11*a* and 11*b* of each lighting opening 16** intermediate the ends of such opening.

Figure 2:
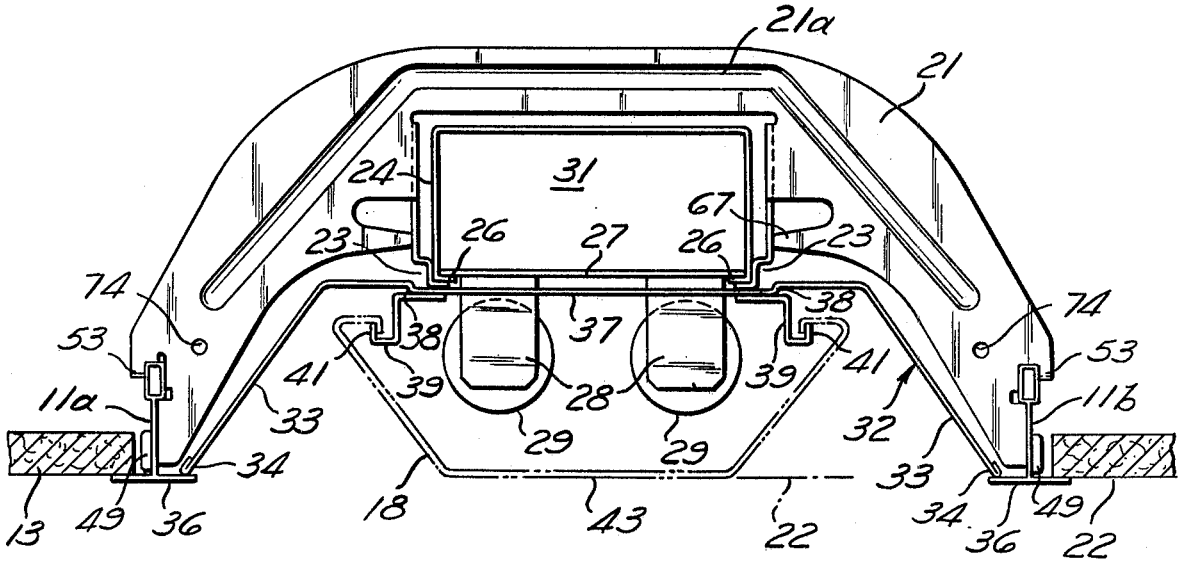
FIG. 2 is a cross section of the assembled system.

A plurality of arched bridging supports 21 are connected at their ends through the side main runs **11*a* and 11*b* and are spaced at intervals along the lighting opening 16. Usually the bridging members are installed at 4 foot intervals. The overall shape of the bridging supports 21 is best illustrated in FIG. 2. These supports function as the principal support of the lighting fixture and also function to provide a substantially rigid cross connection between the side runs 11*a* and 11*b* intermediate the ends of the opening 16. Consequently, the bridging supports 21 operate in cooperation with the cross tees to maintain the runs 11*a* and 11*b* the proper distance apart and maintain them parallel to each other. Generally, a bridging member 21 is provided at the middle and at each end of a fixture subassembly 18. However, additional bridging supports can be provided if it is necessary for the stability of the grid. The bridging supports are preferably formed of relatively heavy gauge material and are provided with a stiffening rib 21*a*** so that they have sufficient stiffness to rigidly connect the main runs and support the fixture in spite of their arched shape.

The bridging supports, along their central section extend above the plane 22 of the ceiling and are provided with support means 23, described in greater detail below which engage, support, and locate channel member 24. The channel members 24 are preferably U-shaped and are open between the inturned lips 26 along their length but provide a support 27 for the sockets 28 of the usual type used in fluorescent lighting. Fluorescent tubes 29 are removably mounted in and are connected to the sockets 28 in the usual manner. In addition, wiring for the fixture (not illustrated) extends along the raceway 31 defined in part by the assembled channel members 24 to power the entire fixture.

A reflector 32 assembled from a plurality of aligned reflector sections is mounted beneath the channel 31 and is formed with inclined sides 33 which extend upwardly and inwardly from edges 34. The edges 34 extend over and rest on the sides of the flanges 36 of the main runs **11*a* and 11*b* which extend inwardly with respect to the opening 16. The reflectors 33 provide a generally horizontal central wall 37 which bridges between the inclined sidewalls 33 and which closes the lower opening of the channel 24. The central wall 37 cooperates with the channel 24 to provide a closed raceway 31. In the illustrated embodiment the reflector is provided with a central wall 37 which is offset at 38. Mounted on the central wall 37 are opposed diffuser brackets 39 providing upstanding lips 41 over which a diffuser 18 is snapped for installation. Preferably the diffuser 18 is formed to extend down to the plane of the ceiling 22 along its center portion 43 and is formed of a translucent material which diffuses the light from the tubes 29** and hides the tubes from view. The illustrated structure provides a sufficient degree of diffuser stiffness while allowing the diffuser to be disconnected along one side so that it can swing down with a hinge action when tube replacement is required.

With the illustrated structure the side runs 11*a* and 11*b* constitute the framing of the lighting fixture and it is not necessary to provide a separate border or framing structure. Further, such arrangement provides an attractive appearance since the fixture appears to be an integral part of the suspension ceiling rather than a separate subsystem within the ceiling.

FIG. 3 best illustrates the integral locking structure for connecting the bridging support 21 at its ends to the runs 11*a* and 11*b*. It should be understood that a similar structure is provided at the opposite end of the bridging support 21 and the run 11*b*. The main run tees have an upstanding web 44 which extends up from the flanges 36 to a bulb 46. Located in the web 44 are openings 47 which are shaped to receive the locking end connections of a standard cross tee manufactured by the assignee of this invention. Such openings are usually located at 6 inch intervals along the length of the tees. The opening 47 is shaped as best illustrated in FIG. 3*a* and is provided with a centrally located upward extension 48 which allows the end 49 of the bridging support 21 to be inserted into the opening and to then drop down and be rotated slightly to the installed position illustrated in which the upper surface 51 is locked under a ledge 52 formed in the opening. After the bridging member is installed at its ends within the opening 47, a tab 53 is bent down to the phantom position of FIG. 3 to complete the locking connection between the bridging support 21 and the main tee. With this structure, it is not necessary to use any bolt screws or the like and the rigid connection is provided between the ends of the bridging support 21 and the tees of the two runs 11*a* and 11*b*, which connection can support the load of the fixture and also prevent lateral movement of the tees toward or away from each other. Therefore, the bridging support 21 functions as part of the grid to stabilize the grid and eliminates the need of cross tees across the lighting opening 16 intermediate its ends. Since the tees of the runs are provided with such openings at regular intervals, the bridging supports can be located at substantially any location. Further, the end of a cross tee can be installed within the same opening 47 as a bridging support so the bridging supports can, and usually are, located in alignment with cross runs.

This structure for supporting the channel 24 and for allowing the installation thereof is best illustrated in FIGS. 4 and 4*a*. The bridging support 21 is formed with a lateral flange 61 which extends from a bend at 62 from the plane of the support. The flange 61 extends down to a step at 63 and then downwardly along a wall 64 to an inturned lip 66. The flange 61 can be bent outward as illustrated in FIG. 4 so that the lips 66 are sufficiently spaced to allow the channel 24 to be rotated upwardly into the assembled position through an intermediate position illustrated in FIG. 4. Because of the step structure 63, sufficient clearance is provided to allow one edge of the channel to be inserted in position first and then the channel rolled up into its installed position.

Figure 6:
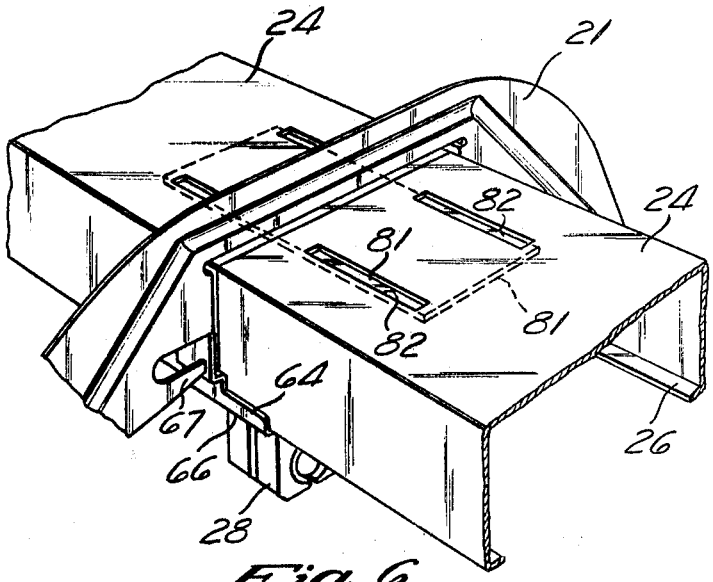
FIG. 6 is a fragmentary perspective view illustrating the channel and support structure at a location where two channel sections are joined; and, FIG. 7 is a fragmentary perspective view illustrating the structure and appearance of the interior of the fixture at its end.

After the channel 24 reaches the installed position the flange 61 is bent inwardly to position the lip 66 under the lip 26 of the channel as illustrated in FIG. 4*a*. At this time a tongue 67 is bent over into alignment with the flange 61 to prevent the flange from springing back and to maintain the lip 66 in position. A similar structure is provided at the other side of the channel support section and the structure permits easy installation of the channel 24 and a positive support for the channel 24. As best illustrated in FIGS. 3 and 6 the wall 64 and the lip 66 is formed with a sufficient length to bridge between the two ends of adjacent channel members and support such ends. This structure also has the advantage of permitting the channel 24 to be adjusted lengthwise with respect to the bridging supports so that when prewired channel sections having end plugs for interconnection are used, it is a simple matter to slide the channel sections together for plugging connection. This allows the placement of the bridging supports at any point along the length of the channels.

Figure 5:
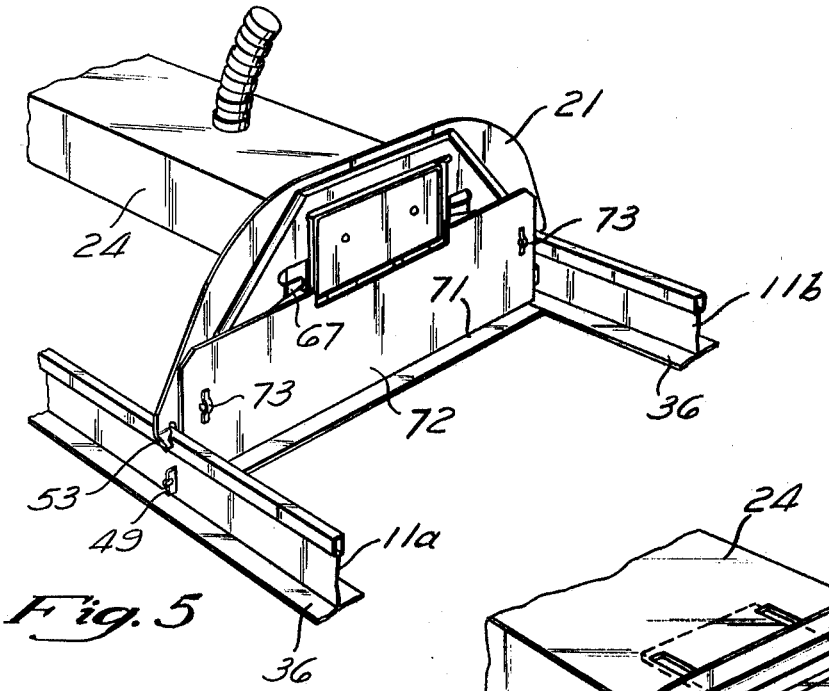
FIG. 5 is a fragmentary perspective view illustrating the end of the fixture incorporating the present invention.

FIG. 5 illustrates a structure provided at the end of the lighting assembly. At the ends of the channel, a fixture end plate 72 is positioned against the bridging element and is secured by spring clips 73 which extend through opening 74 (illustrated in FIG. 3 in the bridging support 21). If required the extension of the wall 64 and the lip 66 can be trimmed off at the end of the fixture. When the reflector is installed it covers the bridging support adjacent to the end plate 72 and the exposed portion of the end plate provides a finished appearance for the end of the fixture.

The end plate 72 is flanged at 71 so that it cooperates with the grid tees at the end of the fixture to define a panel opening to receive a panel 70 (illustrated in FIG. 1).

FIG. 6 illustrates the structure at a joint between two channel members 24. At such location each end of the two channel members 24 extend along and are supported by the lip 66 of the bridging support 21. Preferably, a splicing plate 81 extends between the two abutting ends of the channels to maintain them in alignment and to provide a mechanical connection therebetween. Such splicing plate 81 may, for example, be arranged to fit into longitudinally extending tongues formed by a cut-out and bending operation along the cut-out 82.

Any suitable means may be utilized if desired to provide a positive mechanical locking between the splice plate 81 and ends of the channels to insure that the channels cannot move apart.

Figure 7:
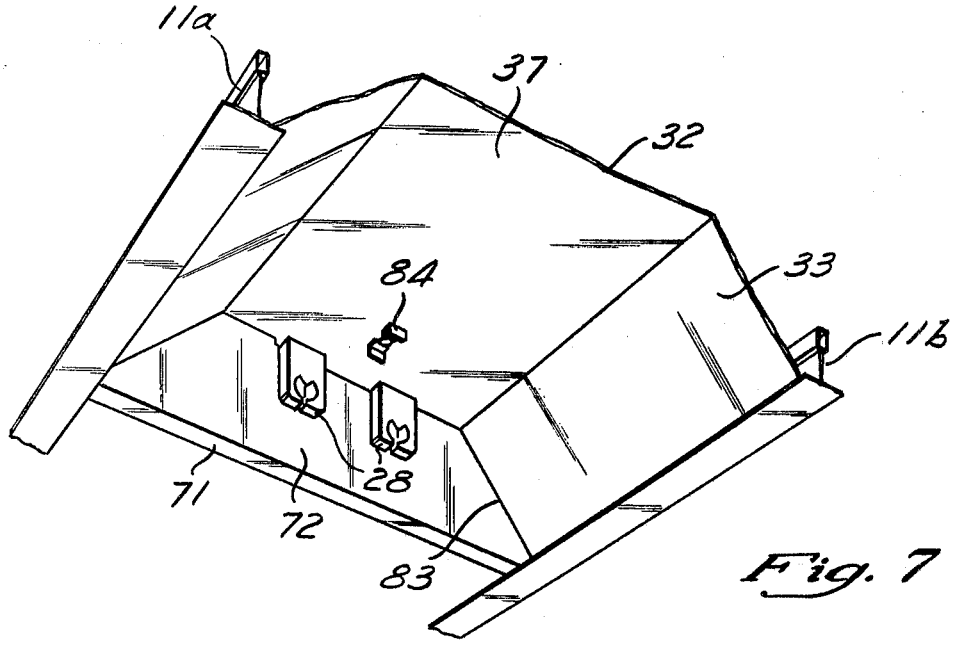

FIG. 7 illustrates one finished form for the reflector which may be used. In such instance, a reflector end 83 is positioned against the plate 72 to provide a pleasing finished appearance. Also, a quarter turn type fastener 84 may be inserted up through the central wall 37 of the reflector 32 to positively lock the reflector into the support 27 of the channel.

The reflector 32 is arch shaped so that it can be easily deflected to move the edges 34 inwardly so that they can move past the flanges 36 during assembly or disassembly. Once the reflector reaches the installed position the edges snap out and rest on the flanges. In practice easy installation and removal of the reflector is accomplished with a "zipper" like action. One end of the reflector section is pressed inwardly and inserted between the flanges. Then as the remaining portions of the reflector are urged past the flanges 36 the edges are pressed inwardly to pass the flanges and then spring back after passage. Such installation or removal from one end of the reflector section toward the other is easily and quickly accomplished.

Because the reflector sections are supported throughout their length by the flanges 36 the adjacent ends are maintained in proper alignment without requiring splice plates.

With the illustrated embodiment of this invention, an integrated suspended ceiling recess lighting system is provided in which substantially any required number of lighting subassemblies 18 may be installed and connected to produce an assembled lighting fixture of substantially any length. Such assembled lighting fixture gives the appearance of being continuous and uninterrupted.

The structure is arranged for ease of installation, low cost manufacture and simplified wiring. For example, the raceway 31 is substantially open through the entire length of the assembled fixture and all of the individual subassemblies can be wired together as a unit before the reflectors are installed. Similarly, if desired pre-wired channel sections can be used in which the ends of the channel sections are provided with mating plugs so that the operation of installing the channels automatically provides connected wiring.

Although a preferred embodiment of this invention is illustrated it is to be understood that various modifications and rearrangements may be resorted to without departing from the scope of the invention disclosed and claimed.

What is claimed is:

1. A recessed lighting system comprising a planar grid defining an elongated lighting opening, said grid including parallel runs of inverted tee members along opposite sides of said opening providing flanges extending inwardly along opposite sides of said opening, a plurality of arched bridging members extending across said opening and locked at their ends to said tee members of said runs, said bridging members operating to maintain a predetermined spacing between said runs, an elongated channel supported by said bridging member above the plane of said grid and providing support for lights and a raceway for wiring, and an elongated unitary reflector extending across said opening and providing opposite edges extending over and resting on said flanges and covering said raceway, said parallel runs along opposite sides of said opening providing the framing of said lighting fixture and in cooperation with said reflector providing the finished enclosure of the sides of said lighting system.

2. A recessed lighting system as set forth in claim 1 wherein said channel is U-shaped and open along its lower side to provide access for wiring or the like, and said reflector fits against and closes said channel when said reflector is installed.

3. A recessed lighting system as set forth in claim 2 wherein said reflector is arch shaped in lateral section and is deformable from its unstressed condition to allow said opposite edges to be pressed inwardly for movement past said flanges.

4. A recessed lighting system as set forth in claim 3 wherein said channel and reflector include a plurality of lengthwise abutting channel sections and reflector sections, said reflector cooperating to provide the appearance of a substantially continuous lighting fixture having a length substantially equal to the length of the entire lighting opening.

5. A recessed lighting system as set forth in claim 4 wherein said system includes a diffuser having a lower surface substantially in the plane of said grid.

6. A recessed lighting system as set forth in claim 5 wherein said diffuser is removably supported by said reflector.

7. A recessed lighting system as set forth in claim 1 wherein said grid includes main tees and interconnected cross tees, said runs are formed with connection openings through which cross tees connect, and said bridging members connect through said connection openings.

8. A recessed lighting system as set forth in claim 1 wherein said bridging members are formed of a single piece of material and include integral lips which fit under and support said channel, and integral lock means preventing release of said channel after it is installed.

9. A recessed lighting system as set forth in claim 8 wherein said lips of said bridging members are bendable inwardly under said channel after installation of said channel, and said lock means includes an integral tongue movable into position to maintain said lips in position under said channel.

10. A recessed lighting fixture as set forth in claim 9 wherein said bridging member is provided with a tab which is bendable to lock the connection with each of said runs.

11. A recessed lighting system as set forth in claim 10 wherein said channel can be mounted in any axial position with respect to said bridging members.

12. An integrated suspension ceiling and recessed lighting fixture comprising a planar grid of main tee and cross tee members interconnected to define panel openings and an elongated lighting opening, said grid being supported from the building structure in which the ceiling is installed, said lighting opening being uninterrupted by tee members, said tee members providing flanges extending inwardly along opposite sides of said lighting opening, a plurality of arched bridging members extending across said lighting opening and connected at their ends to the tee members along the sides of such opening to maintain a predetermined spacing between the tees along the sides of said lighting opening and providing the full support of said bridging members, a raceway supported said bridging members above said grid plane, and a reflector positioned below said raceway and extending across said lighting opening, said reflector extending over said inwardly extending flanges and being supported along its edges directly on said inwardly extending flanges, said tee members in cooperation with said reflector providing the entire framing along the sides of said lighting fixture.

13. An integrated suspension ceiling and recessed lighting fixture as set forth in claim 12 wherein said reflector includes a plurality of endwise abutting reflector sections and an end plate is mounted at each end of said reflector to close the ends of said lighting fixture.

14. An integrated suspension ceiling and recessed lighting fixture as set forth in claim 13 wherein each end plate is formed of a single piece of sheet material and is provided with a flange, said flange cooperating with said main tee and cross tee members to define a panel opening at the end of said fixture.

15. An integrated suspension ceiling and recessed lighting fixture as set forth in claim 13 wherein each end plate is mounted on a bridging member.

16. An integrated suspension and recess lighting fixture as set forth in claim 12 wherein said lighting fixture has an uninterrupted length substantially exceeding the lengths of said main and cross tee members.

17. An integrated suspension ceiling and recessed lighting fixtures as set forth in claim 16 wherein said entire lighting fixture is supplied with power through a single external connection to said channel.

18. A recessed lighting fixture for suspension ceilings which include planar grid of main tee and cross tee members arranged to define an elongated lighting opening and provide inwardly extending flanges along the sides of said opening comprising a plurality of arched bridging members adapted to connect at their ends to the tee members along the sides of said opening and maintain a predetermined spacing therebetween, a raceway adapted to be supported by said bridging members above the plane of said grid and an arched reflector adapted to be positioned below said raceway and extending across said opening with its edges extending over and directly supported on said inwardly extending flanges, said fixture being free of any framing structure along its sides and being entirely framed by the tee members extending along the elongated opening in which it is installed.

19. A recessed lighting fixture as set forth in claim 18 wherein said fixture is provided with a removable diffuser, such fixture being free of separate border framing.

20. A recessed lighting fixture as set forth in claim 18 wherein said tee members include connection openings adapted to lockingly receive the ends of said cross tees, and said bridging member is adapted to lock into said connection openings.

* * * * *